US005909769A

United States Patent [19]

Duhon et al.

[11] Patent Number: 5,909,769

[45] Date of Patent: Jun. 8, 1999

[54] FLUID LOSS DEVICE

[75] Inventors: Peter A. Duhon, Harvey; Kennedy J. Brown, Marrero, both of La.

[73] Assignee: Halliburton Energy Services, Inc., Dallas, Tex.

[21] Appl. No.: 09/058,548

[22] Filed: Apr. 10, 1998

Related U.S. Application Data

[62] Division of application No. 08/600,840, Feb. 13, 1996, Pat. No. 5,775,421.

[51] Int. Cl.[6] ..... E21B 33/12

[52] U.S. Cl. ..... 166/115; 166/135

[58] Field of Search ..... 166/115, 116, 166/114, 135, 188, 192, 239, 317

[56] References Cited

U.S. PATENT DOCUMENTS

| | | | |
|---|---|---|---|
| Re. 34,758 | 10/1994 | Farley et al. | 166/319 |
| 2,508,286 | 5/1950 | Otis | 166/188 |
| 2,859,825 | 11/1958 | Wilhoit | 166/332.7 |
| 2,884,071 | 4/1959 | Fredd | 166/192 |
| 3,100,532 | 8/1963 | Tamplen | 166/123 |
| 3,180,420 | 4/1965 | Manson, Jr. et al. | 166/133 |
| 3,454,089 | 7/1969 | Brown | 166/332.6 |
| 4,058,162 | 11/1977 | Smith | 166/135 |
| 4,121,660 | 10/1978 | Koleilat | 166/135 |
| 4,405,017 | 9/1983 | Allen et al. | 166/382 |
| 4,662,447 | 5/1987 | Bolin | 166/278 |
| 4,718,488 | 1/1988 | Pringle et al. | 166/135 |
| 4,828,037 | 5/1989 | Lindsey et al. | 166/238 |
| 4,893,678 | 1/1990 | Stokley et al. | 166/238 |
| 4,944,348 | 7/1990 | Whiteley et al. | 166/278 |
| 5,318,117 | 6/1994 | Echols, III et al. | 166/114 |
| 5,343,949 | 9/1994 | Ross et al. | 166/278 |
| 5,579,844 | 12/1996 | Rebardi et al. | 166/296 |
| 5,609,204 | 3/1997 | Rebardi et al. | 166/51 |
| 5,775,422 | 7/1998 | Wong et al. | 166/135 |

OTHER PUBLICATIONS

OSCA, "Techical Bulletin—Traveling Disk Valve", Date Unknown, 3 pages.

*Primary Examiner*—Hoang C. Dang
*Attorney, Agent, or Firm*—Paul I. Herman; Jeffery E. Bacon

[57] ABSTRACT

A fluid loss device has a housing, a seal assembly, a running tool, and a plug. The housing of the fluid loss device is placed in a production string before a well bore is completed. The plug is attached to the running tool, and the running tool is attached to a wash pipe.

The fluid loss device is activated by lifting the wash pipe and the running tool, thereby engaging the plug with the seal assembly, engaging the seal assembly with the housing, and severing the plug from the running tool. Activation of the fluid loss device inhibits fluid communication through the fluid loss device and reduces damage to the well structure behind the fluid loss device while completion operations are performed in other areas of the well bore.

The fluid loss device is deactivated by forcing the plug through the fluid loss device with mechanical force or pressure, or by chemically eroding the diameter of the plug until the plug passes through the fluid loss device. Once the fluid loss device is deactivated, the isolated area of the well bore is reopened for access through the production string.

7 Claims, 15 Drawing Sheets

FLUID LOSS DEVICE

This application is a (Divisional) of prior application Ser. No. 08/600,840 filed on Feb. 13, 1996, now U.S. Pat. No. 5,775,421.

BACKGROUND

The present invention relates generally to apparatus for well completions, and in particular, to apparatus for isolating distinct zones from each other in a well bore.

In completion of a well bore for oil, gas, or the like, it is often desired to perform certain completion operations in a particular zone of the well bore, such as gravel packing, acidizing, or the like. After completion of one of these operations, it is often necessary to protect the structure in which the operation was performed by isolating the zone in which the operation was performed from other zones of the well bore during completion operations of the other zones. However, after operations in the other isolation areas of the well bore have been completed, it is necessary to open the isolated area to complete the well bore. Therefore, there is a need for apparatus and methods for isolating a zone of the well bore that can be re-opened for final completion of the well bore.

Completion of the well bore can be affected by the type of debris that is created within that well bore. Therefore, there is a need for apparatus and methods of isolating particular zones in a well bore that reduce the amount of debris that negatively influences the completion of the well bore.

Before a zone is isolated in a well bore, it may be necessary to draw fluids from the zone to be isolated through any device that is later used to isolate the particular zone. Fluid flow through an isolation device, prior to use of the device to isolate a particular zone, may be at high flow rates. Therefore, there is a need for apparatus and methods which allow high fluid flow to and from the zone to be isolated, prior to isolating that particular zone.

SUMMARY

The present invention is directed to an apparatus that satisfies the above mentioned need.

In one embodiment, the apparatus comprises a fluid loss device with a housing, a seal assembly, a running tool, and a plug. The housing has a longitudinal bore therethrough. The seal assembly includes a compression sleeve and a collet sleeve. The compression sleeve is positioned within the longitudinal bore of the housing and has an inner compression land. The collet sleeve is positioned within the compression sleeve and has a collet seal section with an outer compression land that is larger than the inner compression land of the compression sleeve. The plug is detachably attached to the running tool. This particular embodiment of the fluid loss device also includes means for sealing between the compression sleeve and the housing, and means for securing the inner compression land of the compression sleeve in engagement with the outer compression land of the collet sleeve such that the collet seal section of the collet sleeve is reduced to a predetermined size for sealing engagement with the plug.

In another embodiment, the present invention comprises a fluid loss device with a housing, a seal assembly, a running tool, a plug, a housing seal and, a plug seal. The housing has a longitudinal bore therethrough. The seal assembly has a plug bore therethrough. The plug is detachably attached to the running tool. The housing seal is adapted for providing a sealing engagement between the seal assembly and the longitudinal bore in the housing. This particular embodiment of the fluid loss device also includes means for releasably securing the seal assembly within the longitudinal bore of the housing such that the housing seal provides a seal between the seal assembly and the longitudinal bore of the housing. The plug seal is adapted for providing sealing engagement between the plug bore of the seal assembly and the plug. This particular embodiment of the fluid loss device also includes means for releasably securing the plug within the plug bore of the seal assembly such that the plug seal provides a seal between the plug and the plug bore of the seal assembly.

In a further embodiment, the seal assembly includes a compression sleeve and a collet sleeve, the plug seal includes a collet seal section on the collet sleeve, and the means for releasably securing the plug further includes an inner compression land on the compression sleeve, an outer compression land on the collet seal section of the collet sleeve, and means for securing the inner compression land in engagement with the outer compression land. The compression sleeve is positioned within the longitudinal bore of the housing. The outer compression land is larger than the inner compression land. The means for securing the inner compression land in engagement with the outer compression land is adapted for securing the inner compression land in engagement with the outer compression land of the collet sleeve such that the collet seal section in the collet sleeve is reduced to a predetermined size for engagement with the plug.

In another further embodiment, the means for releasably securing the seal assembly comprises a stop dog, a stop dog aperture in the seal assembly, a stop dog recess in the housing, and the plug has a stop dog release surface, a stop dog locking surface, and a stop dog cam surface connecting the two surfaces. The plug is disposed within the plug bore of the seal assembly such that the stop dog rests against the stop dog release surface, and movement of the plug causes the stop dog to follow the stop dog cam surface to the stop dog locking surface. The stop dog locking surface is such that the stop dog is forced to extend outwardly from the stop dog aperture in the seal assembly and into the stop dog recess in housing.

Another embodiment includes a shear pin recess in a shear pin surface of the plug, the seal assembly includes a shear pin aperture, and the means for securing the plug includes a shear pin disposed within the shear pin aperture of the seal assembly and means for forcing the shear pin against the shear pin surface of the plug such that alignment of the shear pin recess in the plug will force the shear pin into engagement with the shear pin recess of the plug and the shear pin aperture of the seal assembly.

In another further embodiment, the running tool includes a running tool mandrel having a skirt stop land and means for detachably attaching the plug, a running tool skirt having a mandrel stop land, and means for engaging the skirt stop land with the mandrel stop land. The skirt stop land of the running tool mandrel and the mandrel stop land of the running tool skirt are positioned such that when the plug detaches from the running tool mandrel the skirt stop land of the running tool mandrel contacts the mandrel stop land of the running tool skirt and the running tool skirt inhibits the running tool mandrel from contacting the plug.

BRIEF DESCRIPTION OF THE DRAWINGS

A more complete understanding of the apparatus and methods of the present invention may be had by reference to the following Detailed Description when taken in conjunction with the accompanying Drawings wherein.

DETAILED DESCRIPTION

Figure 1:
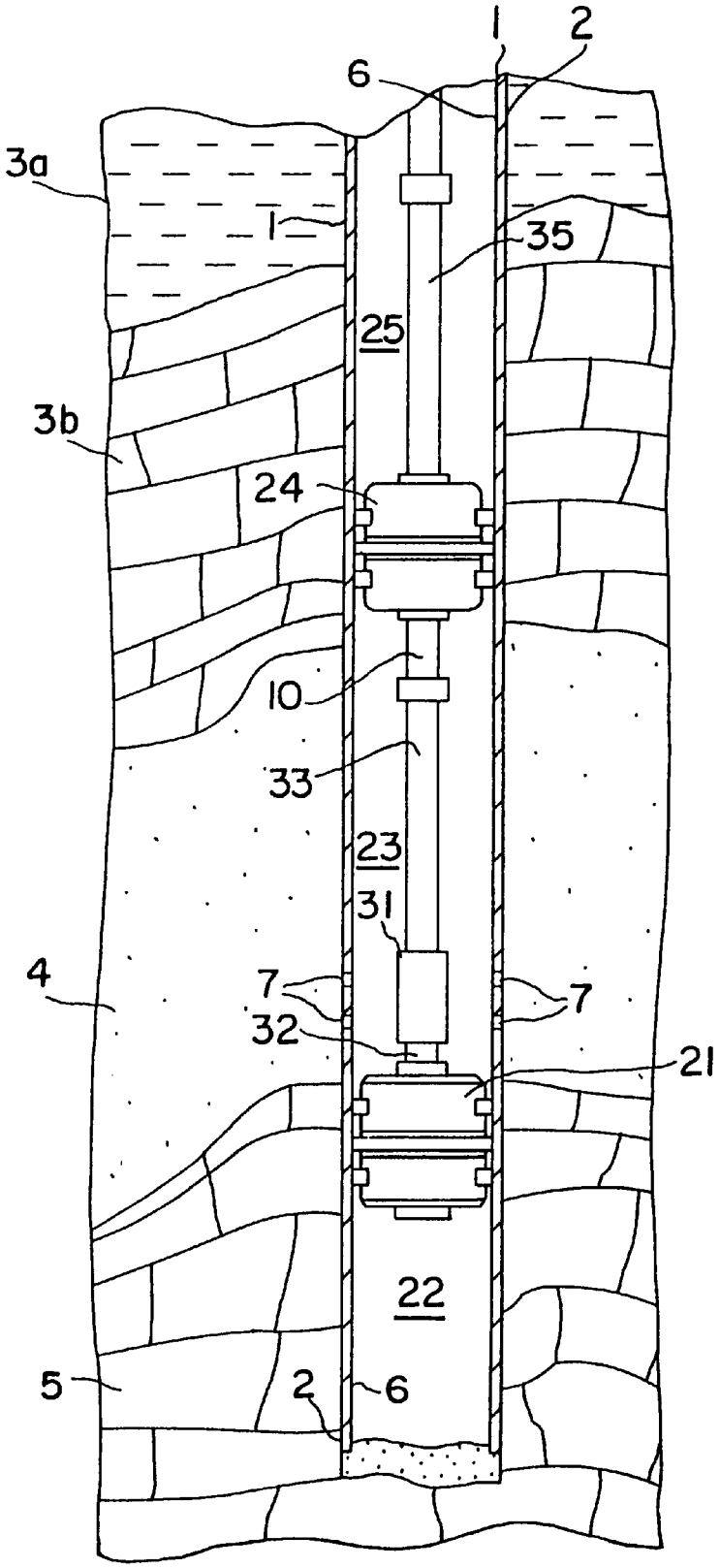
FIG. 1 is a fragmentary view in section and elevation of a well bore utilizing an embodiment of the present invention.

A well bore 1 is shown in FIG. 1 and generally comprises a bore hole 2 drilled through non-producing overburden layers 3*a*, 3*b*, a producing or pay zone 4, and a non-producing zone 5. A tubular casing 6 is cemented into the bore hole 2. Perforations 7 are located in the casing 6 within the producing zone 4. A production zone 23 of the well bore 1 is separated from a sump zone 22 of the well bore 1 by a sump packer 21. The production zone 23 of the well bore 1 is separated from an upper zone 25 of the well bore 1 by an upper packer 24. Between the sump packer 21 and the upper packer 24 is placed a well filtration device such as a well screen 31. The well screen 31 is connected to the sump packer 21 by a seal 32. The screen 31 is also connected by blank production tubing 33 to the fluid loss device 10, which is connected to the upper packer 24. Connection from above the upper packer 24 is accomplished by the upper production tubing 35.

Figure 2:
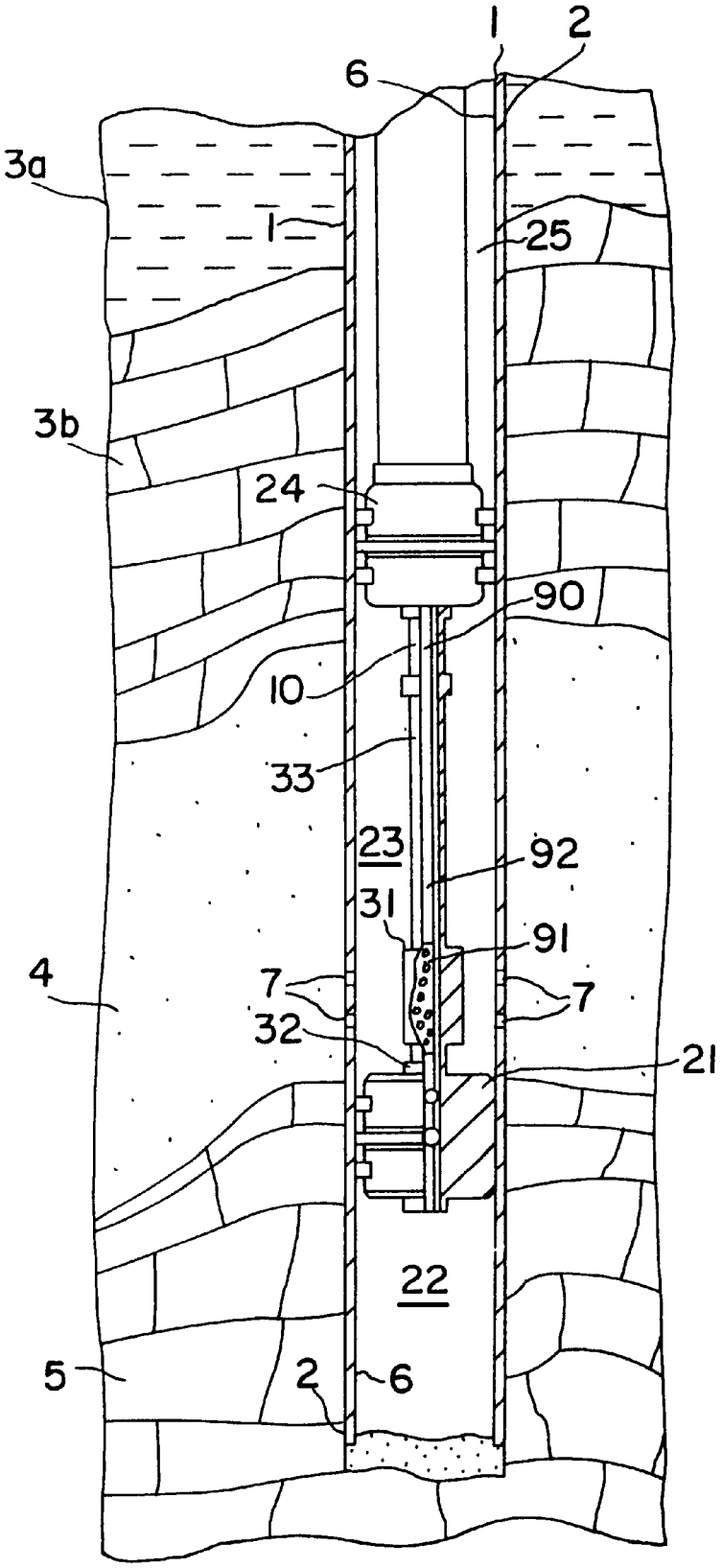
FIG. 2 is a view as in FIG. 1, further illustrating in section the present invention from FIG. 1.

In one operation where gravel packing is performed, as shown in FIGS. 1 and 2, a wash pipe assembly 90, having a perforated subassembly 91 on the end of a wash pipe 92, is inserted through the fluid loss device 10 and the blank production tubing 33 before the upper production tubing 35 is connected to the upper packer 24. The wash pipe assembly 90 is positioned with the perforations of the perforated subassembly 91 located behind the screen 31.

After the wash pipe assembly 90 is positioned with the perforated subassembly 91 behind the screen 31, gravel is pumped into the production zone 23 of the well bore 1 the annulus around the outside of the fluid loss device 10, the blank production tubing 33, the screen 31, and the seal 32. During the time when gravel is pumped into the production zone 23 of the well bore 1, fluids passing through the screen 31 are drawn through the perforations of the perforated subassembly 91, and exit the well bore 1 through the wash pipe 92. Other operations can also be performed with the wash pipe assembly 90, such as acidizing.

After the operations requiring the wash pipe assembly 90 are performed, it is often desired to protect the formations created by these operations from other operations in the upper zone 25 of the well bore 1 by sealing off the production zone 23 from the upper zone 25 while these other operations are being performed. To seal off the production zone 23 from the upper zone 25, the fluid loss device 10 is activated and the wash pipe assembly 90 is withdrawn from the well screen 31, the blank production tubing 33, and the fluid loss device 10. Once the operations above the production zone 23 are completed, the fluid loss device 10 is deactivated or cleared to allow communication with the upper production tubing 35.

Figure 3:
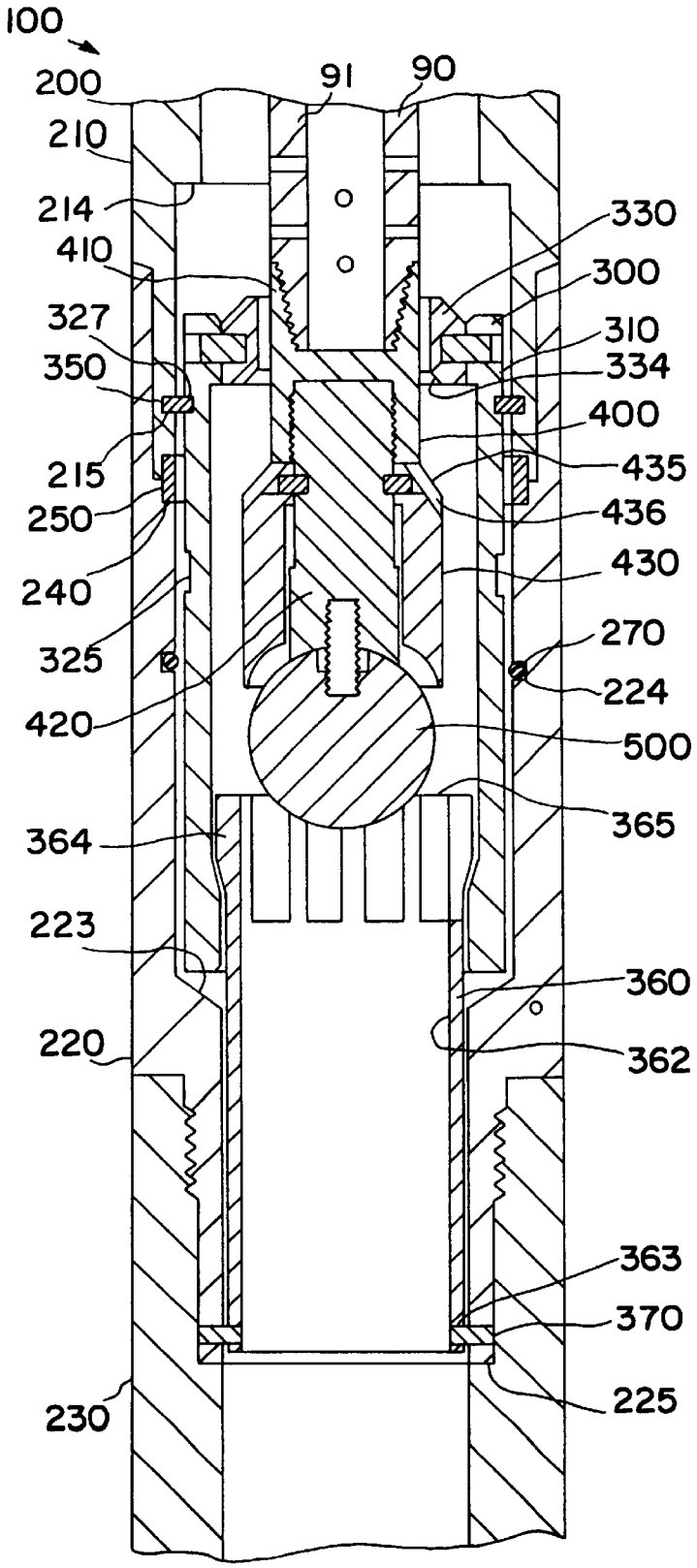
FIG. 3 is an enlarged fragmentary view in section and elevation of an embodiment of the fluid loss device in FIGS. 1 and 2.
Figure 4:
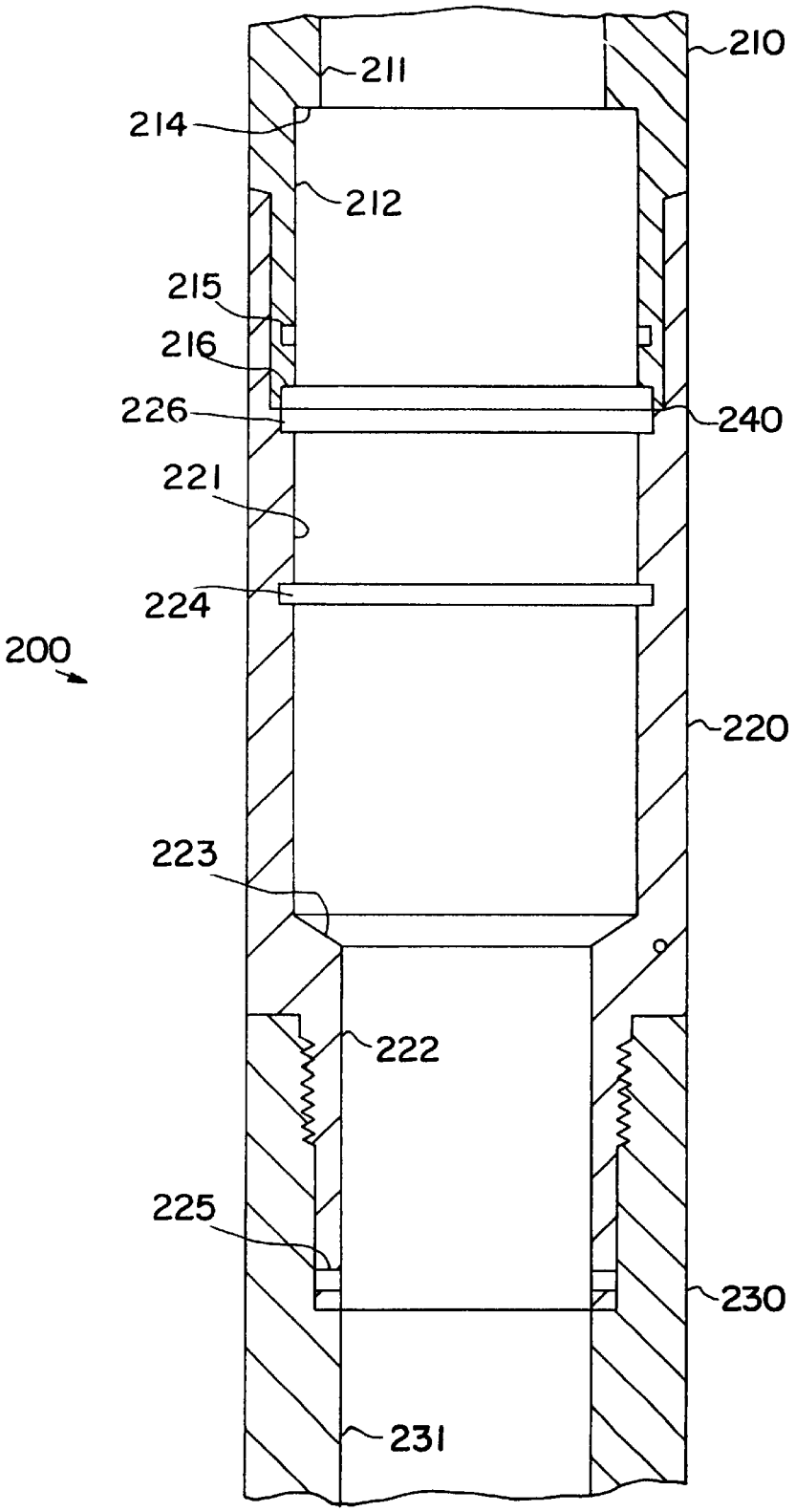
FIG. 4 is a sectional view of the housing in FIG. 3.

One embodiment of the fluid loss device 10 of FIGS. 1 and 2 is illustrated in FIG. 3 as the fluid loss device 100. The fluid loss device 100 generally comprises a housing 200, a seal assembly 300, a running tool assembly 400, and a plug or ball 500. The housing 200, as shown in FIGS. 3 and 4, comprises a top sub 210, a middle sub 220, and a bottom sub 230. An upper portion of the top sub 210 of the fluid loss device 100 attaches to the upper packer 24 (shown in FIGS. 1 and 2), and a lower portion of the top sub 210 attaches to an upper portion of the middle sub 220. An upper portion of the bottom sub 230 attaches to a lower portion of the middle sub 220, and a lower portion of the bottom sub 230 attaches to the blank tubing 33 (shown in FIGS. 1 and 2).

As seen in FIG. 4, the top sub has a first inner diameter 211 in the upper portion, and a larger second inner diameter 212 in the lower portion. A stop land 214 is created between the first inner diameter 211 and the second inner diameter 212 of the top sub 210. The middle sub 220 has a first inner diameter 221 in the upper portion, and a second inner diameter 222 in the lower portion. A stop land 223 is created between the first inner diameter 221 and the second inner diameter 222 of the middle sub 220. The bottom sub 230 has an inner diameter 231. In one embodiment, the first inner diameter 211 of the top sub 210 is approximately the same diameter as the second inner diameter 222 of the middle sub 220, and the inner diameter 231 of the bottom sub 230 is approximately the same diameter as the second inner diameter 222 of the middle sub 220. A snap ring groove 240 is defined by a snap ring recess 216 in the lower portion of the top sub 210 aligning with a snap ring recess 226 in the upper portion of the middle sub 220. A snap ring 250 resides within the snap ring groove 240, as seen in FIG. 3. A seal 270 resides within a seal groove 224 that is recessed into the first inner diameter 221 of the middle sub 220.

Figure 5:
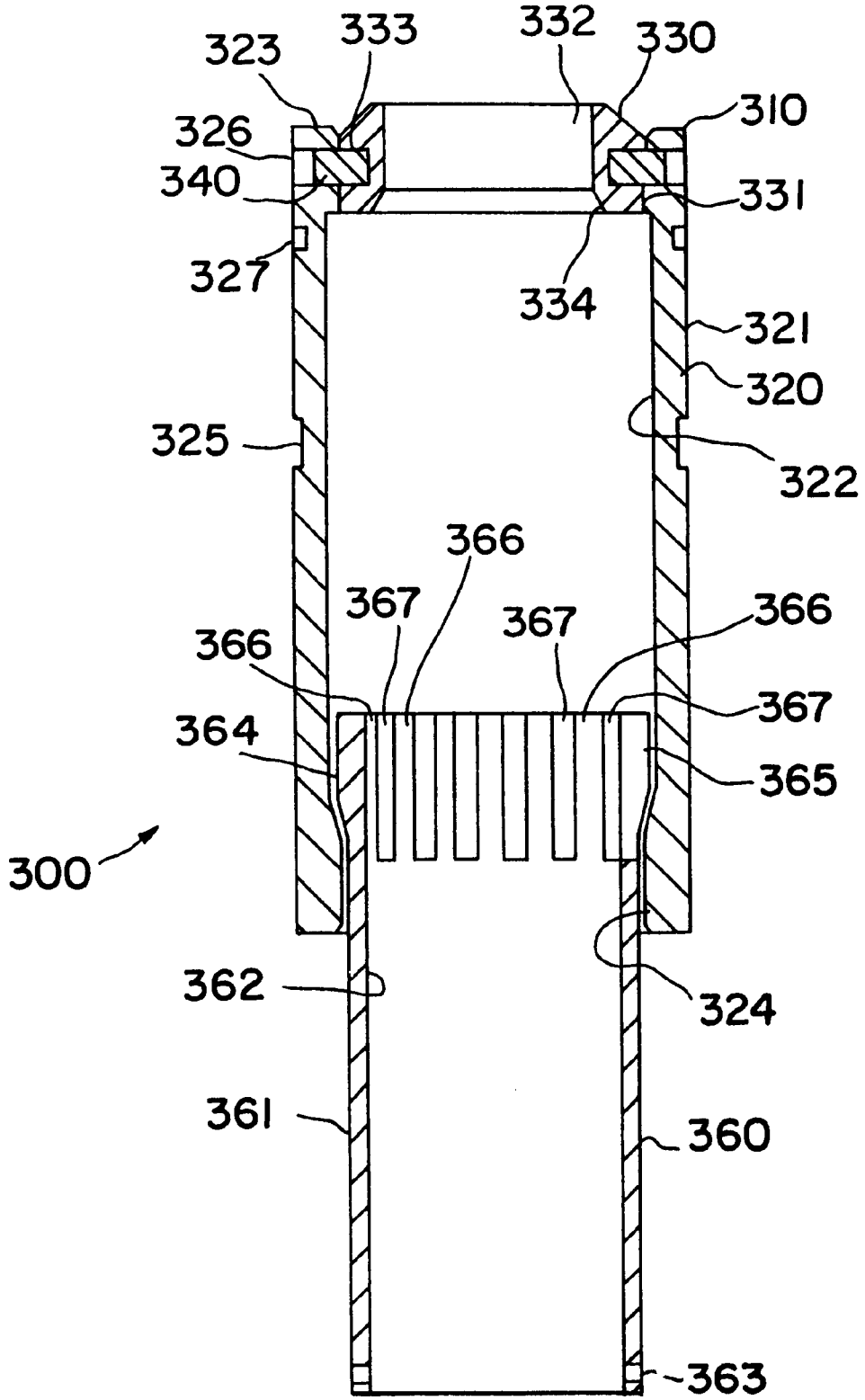
FIG. 5 is a sectional view of the seal assembly in FIG. 3.

In one embodiment, the seal assembly 300, as shown in FIGS. 3 and 5, includes a compression sleeve assembly 310 and a collet seal assembly 360. The compression sleeve assembly 310 generally comprises a sleeve 320 and a shear ring 330. The sleeve 320 has an outer diameter 321 and an inner diameter 322. At the upper end of the sleeve 320, a sleeve stop edge 323 is created between the outer diameter 321 and the inner diameter 322. At the lower end of the sleeve 320, a compression land 324 is created by decreasing the inner diameter 322 of the sleeve 320. A snap ring groove 325 is recessed into the outer diameter 321 of the sleeve 320.

The shear ring 330 has an outer diameter 331 smaller than the inner diameter 322 of the sleeve 320, and a inner diameter 332 larger than the diameter of the wash pipe assembly 90. A running tool interface edge 334 is created on a lower edge of the shear ring 330 between the outer diameter 331 and the inner diameter 332. The shear ring 330 is secured to the sleeve 320 by a plurality of shear pins 340 disposed within shear pin apertures 333 in the shear ring 330 and shear pin apertures 326 in the sleeve 320. The compression sleeve assembly 310 is secured to the housing 200 by a plurality of shear pins 350, seen in FIG. 3, engaging shear pin apertures 327 in the sleeve 320 and shear pin apertures 215 in the top sub 210 of the housing 200.

In FIG. 5 the collet seal assembly 360 has an outer diameter 361 and an inner diameter 362. The outer diameter 361 is smaller than the second inner diameter 222 of the middle sub 220. A collet seal 365 is created in an upper portion of the collet seal assembly 360 by alternating seal fingers 366 and resilient seal material 367 longitudinally in the walls of the collet seal assembly 360. A compression land 364 is created on an upper portion of the collet seal 365 by increasing the outer diameter 361 of the collet seal 365 to a diameter larger than the compression land 324 of the sleeve 320 in the compression sleeve assembly 310, but smaller than the inner diameter 322 of the sleeve 320. The collet seal assembly 360 is secured to the housing 200 by a plurality of shear pins 370, seen in FIG. 3, secured within shear pin apertures 363 in the collet seal assembly 360 and shear pin apertures 225 in the middle sub 220 of the housing 200.

Figure 6:
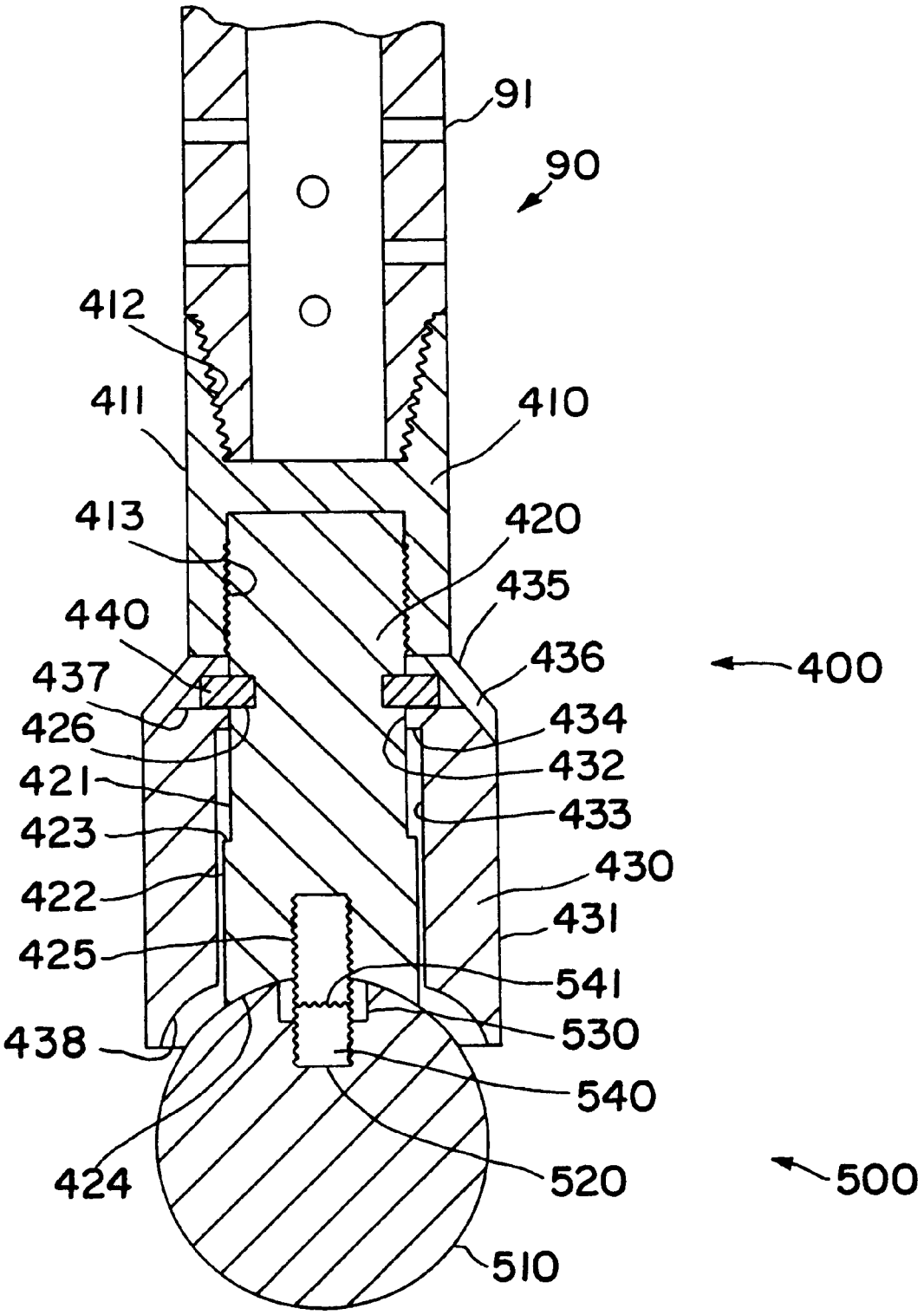
FIG. 6 is a sectional view of the wash pipe assembly, running tool assembly, and plug in FIG. 3.

The running tool 400 assembly, as shown in FIGS. 3 and 6, generally comprises a mounting collar 410, a running tool mandrel 420 and a running tool shear sleeve 430. The mounting collar 410 has an outer diameter 411 smaller than the inner diameter 332 of the shear ring 330 in the compression sleeve assembly 310. At an upper end of the mounting collar 410 is a threaded wash pipe mounting aperture 412 for engagement of the wash pipe assembly 90. At a lower end of the mounting collar 410 is a threaded mandrel aperture 413 for engagement of the running tool mandrel 420.

The running tool mandrel 420 has a first diameter 421 on an upper portion of the running tool mandrel 420 and a second diameter 422 on a lower portion of the running tool mandrel 420. The first diameter 421 of the running tool mandrel 420 is smaller than the second diameter 422, creating a stop land 423 on the running tool mandrel 420. On the lower end of the running tool mandrel 420 is a concave ball mounting recess 424. A threaded ball mounting bolt aperture 425 extends upwardly into the running tool mandrel 420 through the concave ball mounting recess 424.

The running tool shear sleeve 430 has an outer diameter 431, a first inner diameter 432, and a second inner diameter 433. The outer diameter 431 of the running tool shear sleeve 430 is greater than the inner diameter 332 of the shear ring 330, but smaller than the inner diameter 322 of the sleeve 320. The first inner diameter 432 of the running tool shear sleeve 430 is larger than the first diameter 421 of the running tool mandrel 420, but smaller than the second diameter 422 of the running tool mandrel 420. The second inner diameter 433 of the running tool shear sleeve 430 is larger than the second diameter 422 of the running tool mandrel 420. A stop land 434 is created inside the running tool shear sleeve 430 between the first inner diameter 432 and the second inner diameter 433. In this manner, the stop land 434 of the running tool shear sleeve 430 will engage the stop land 423 of the running tool mandrel 420.

A shear ring interface edge 435 is located on the upper edge of the running tool shear sleeve 430 between the outer diameter 431 and the first inner diameter 432, such that vertical engagement with the running tool interface edge 334, seen in FIG. 3, of the shear ring 330 is possible. By-pass grooves 436 are positioned within the shear ring interface edge 435 of the running tool shear sleeve 430 such that metered fluid by-pass is possible when the shear ring interface edge 435 of the running tool shear sleeve 430 engages the running tool interface edge 334 of the shear ring 330. At the lower edge of the running tool shear sleeve 430, a ball interface surface 438 is defined between the outer diameter 431 and the second inner diameter 433. The running tool shear sleeve 430 is mounted to the running tool mandrel 420 by a plurality of shear pins 440 secured within the shear pin apertures 437 in the running tool shear sleeve 430 and shear pin apertures 426 in the running tool mandrel 420.

The plug or ball 500, as shown in FIGS. 3 and 6, has an outer diameter 510 that is smaller than the inner diameter 362 of the collet seal assembly 360 in a relaxed position. A ball attachment bolt 540 is secured within a threaded bolt aperture 520 of the ball 500. A fracture clearance recess 530 provides clearance between the ball 500 and the ball attachment bolt 540 below the surface of the outer diameter 510 of the ball 500. The ball attachment bolt 540 has a prestressed area 541 which is located below the outer diameter 510 of the ball 500 and within the fracture clearance recess 530. The ball 500 is secured to the concave ball mounting recess 424 of the running tool mandrel 420 by engaging the ball attachment bolt 540 with the threaded ball mounting bolt aperture 425.

Figure 7A:
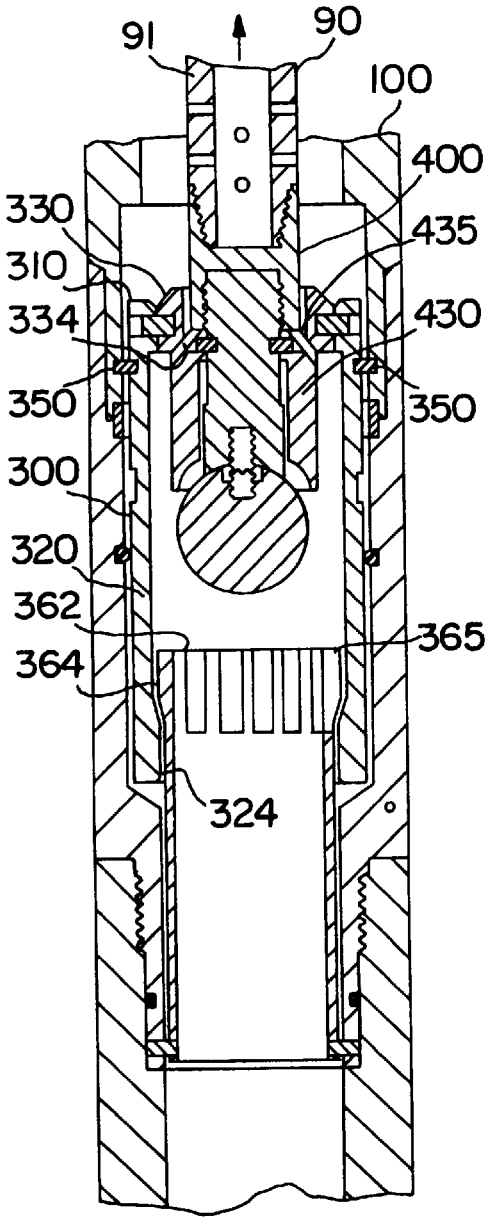
FIGS. 7A–7F are sectional views illustrating operation of the fluid loss device in FIGS. 3–6.

In one operation to activate the fluid loss device 100, the wash pipe assembly 90 and the running tool assembly 400 are drawn upwardly through the fluid loss device 100 until the shear ring interface edge 435 on the running tool shear sleeve 430 of the running tool assembly 400 engages the running tool interface edge 334 on the shear ring 330 of the compression sleeve assembly 310, as shown in FIG. 7A. The wash pipe assembly 90 continues to be lifted upwardly through the fluid loss device 100 until the running tool 400 shears the shear pins 350 allowing the compression sleeve assembly 310 to progress upwardly through the fluid loss device 100 with running tool assembly 400 and the wash pipe assembly 90. As the compression sleeve assembly 310 progresses upwardly with the running tool assembly 400 and the wash pipe assembly 90 through the fluid loss device 100, the compression land 324 of the sleeve 320 will engage the compression land 364 of the collet seal assembly 360, thereby reducing the inner diameter 362 of the collet seal 365.

Figure 7B:
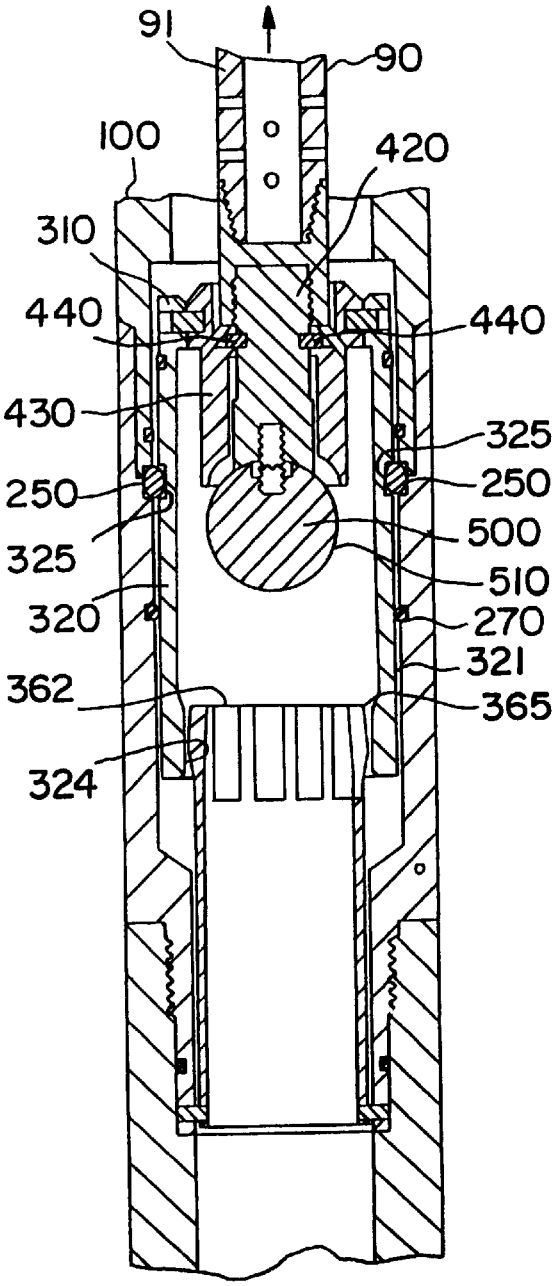

At a point where the compression land 324 of the sleeve 320 reduces the inner diameter 362 of the collet seal 365 to a diameter smaller than the outer diameter 510 of the ball 500, the snap ring 250 will engage the snap ring groove 325 in the sleeve 320, thus preventing further upward movement of the compression sleeve assembly 310 in the fluid loss device 100, as shown in FIG. 7B. In the position where the snap ring 250 engages the snap ring groove 325, the seal 270 will engage the outer diameter 321 of the sleeve 320. After the snap ring 250 engages the snap ring groove 325 in the sleeve 320, movement of the wash pipe assembly 90 upwardly will sever the shear pins 440 that secure the running tool shear sleeve 430 to the running tool mandrel 420.

Figure 7C:
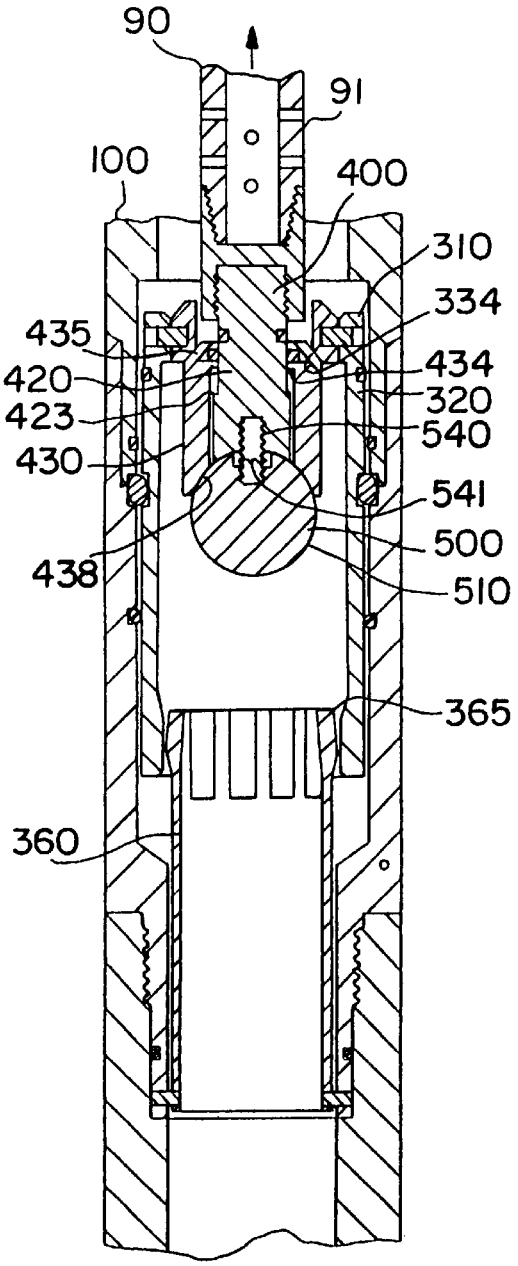

Continued upward movement of the wash pipe assembly 90 and the running tool assembly 400 will pull the shear ring interface edge 435 of the running tool shear sleeve 430 into engagement with the running tool interface edge 334 of the compression sleeve assembly 310, and the ball interface surface 438 of the running tool shear sleeve 430 into engagement with the ball 500, as shown in FIG. 7C. The force of the wash pipe assembly 90 and the running tool 400 being drawn upwardly through the fluid loss device 100 cause the ball attachment bolt 540 to sever at the prestressed area 541 below the outer diameter 510 of the ball 500. Once the ball attachment bolt 540 is severed, the ball 500 will drop into engagement with the collet seal 365 of the collet seal assembly 360, thereby blocking flow through the fluid loss device 100. After the ball 500 has separated from the running tool mandrel 420, the stop land 434 of the running tool shear sleeve 430 will engage the stop land 423 of the running tool mandrel, as seen in FIG. 7D 420.

Figure 7D:
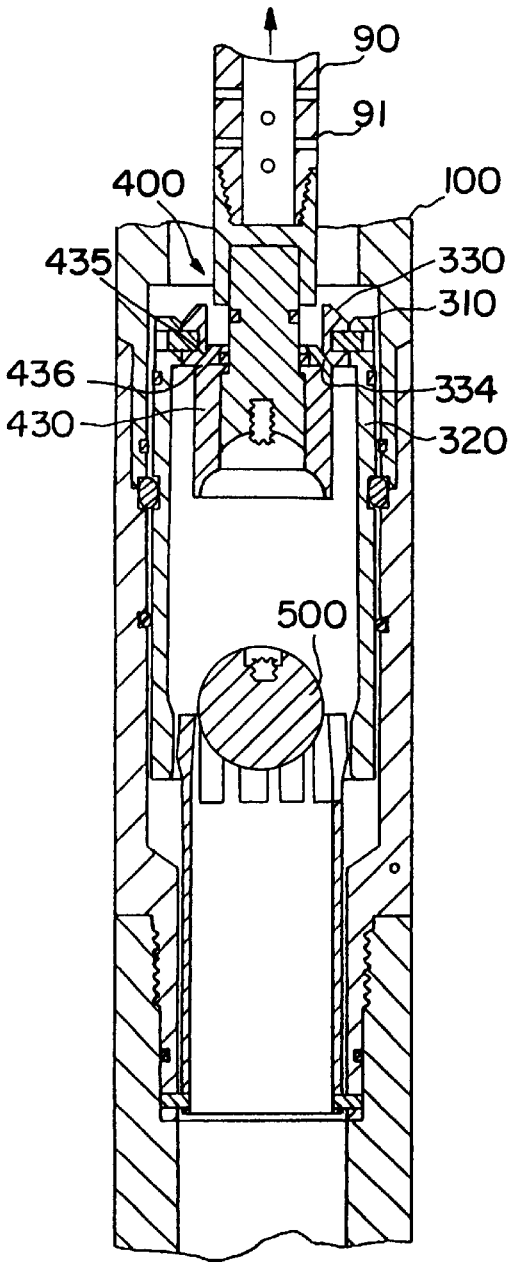

Continued movement of the wash pipe 90 and running tool 400 upwardly through the fluid loss device 100 will bring the shear ring interface edge 435 on the running tool shear sleeve 430 into engagement with the running tool interface edge 334 on the shear ring 330 of the compression sleeve assembly 310, as shown in FIG. 7D. During the time period in which the shear ring interface edge 435 engages the running tool interface edge 334, by-pass grooves 436 in the shear ring interface edge 435 allow a metered quantity of fluid to pass from above the shear ring 330 to below the running tool shear sleeve 430. In this manner, the pressure above and below the shear ring 330 and the running tool shear sleeve 430 are maintained at an approximately equal pressure, preventing a sudden surge of pressure on the ball 500 below when the shear ring 330 is separated from the sleeve 320.

Figure 7E:
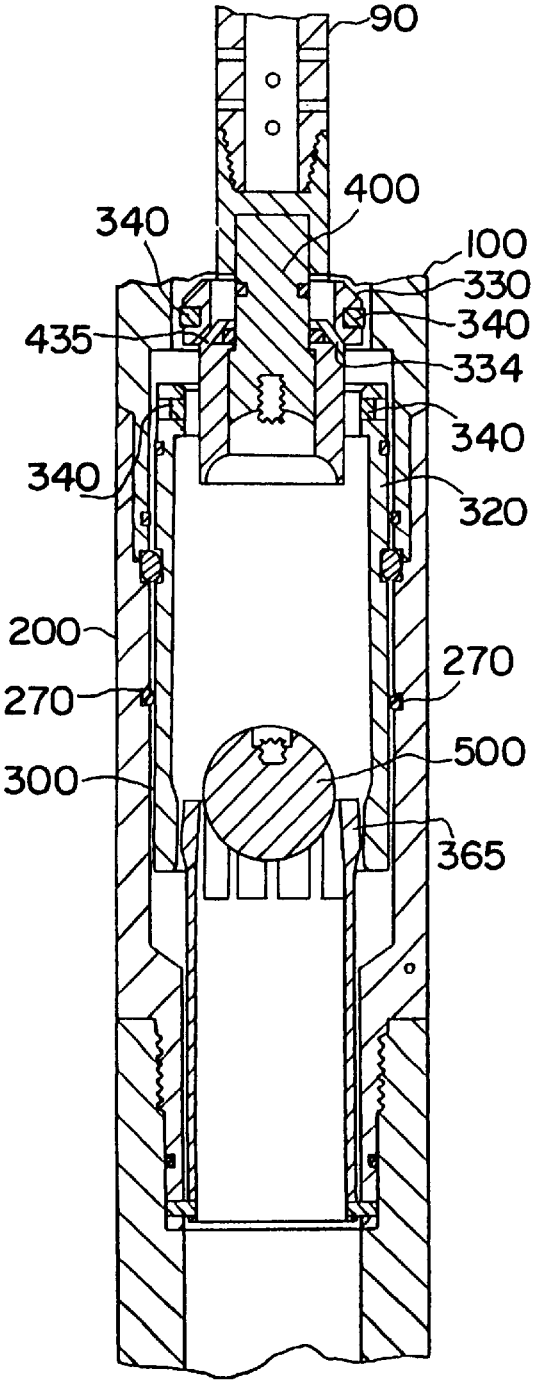

Continued upward forces of the wash pipe 90 and running tool 400 will be transmitted by the shear ring interface edge 435 to the running tool interface edge 334, severing the shear pins 340 connecting the shear ring 330 to the sleeve 320, as shown in FIG. 7E. Removal of the wash pipe assembly 90 and the running tool 400 from the fluid loss device 100 leaves the ball 500 sealed against the collet seal 365, thereby restricting flow from the above the fluid loss device 100 to below the fluid loss device 100.

Once the ball 500 has separated from the running tool mandrel 420 and engaged the collet seal 365, the fluid loss device 100 is in an activated condition. In the activated position, the seal 270 provides a seal between the housing 200 and the seal assembly 300, and the collet seal 365 provides a seal between the seal assembly 300 and the ball 500. Thus, in the activated condition, the fluid loss device 100 prohibits communication from above the fluid loss device 100 to below the fluid loss device 100.

Figure 7F:
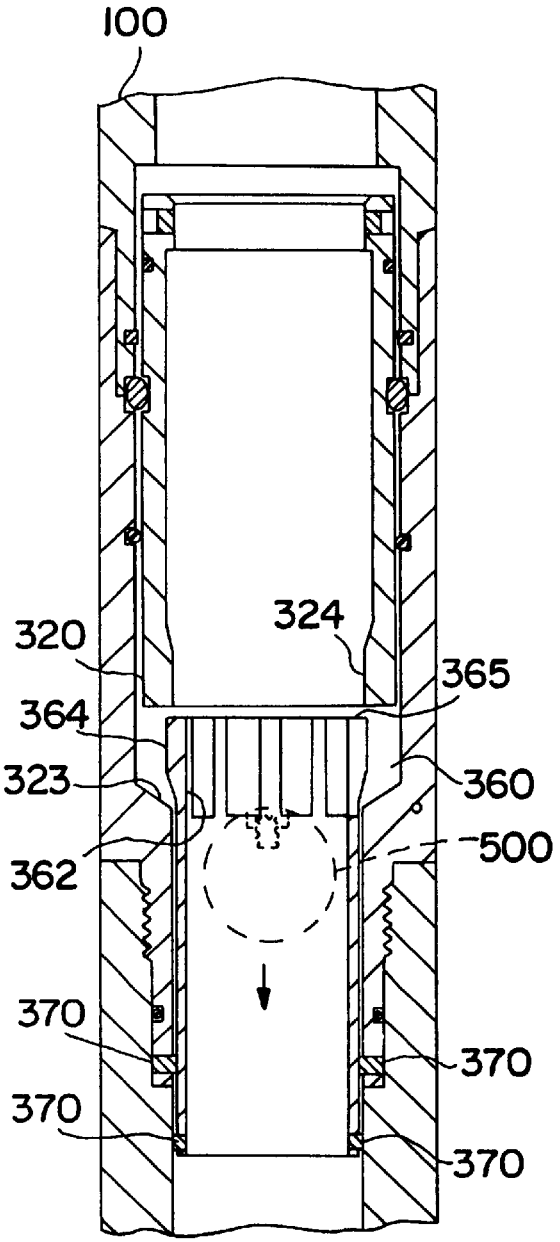

At some point after the ball 500 engages the collet seal 365 preventing flow downward through the fluid loss device 100, it will be desired to deactivate or open the fluid loss device 100 to once again allow flow through the fluid loss device 100. To allow flow to resume through the fluid loss device 100, the ball 500 must be cleared from the collet seal 365, as shown in FIG. 7F. Three possible methods can be used to clear the ball 500 from the collet seal 365: mechanical, pressure, or chemical.

The ball 500 can be forced clear of the collet seal 365 by applying a downward mechanical force to the ball 500. Force applied to the ball 500 is transmitted to the shear pins 370 by the collet seal assembly 360. When the force exerted on the ball 500 is great enough to sever the shear pins 370, the ball 500 and the collet seal assembly 360 will progress downward through the fluid loss device 100 until the compression land 364 of the collet seal assembly 360 clears the compression land 324 of the sleeve 320. Once the compression land 364 of the collet seal assembly 360 clears the compression land 324 of the sleeve 320, the collet seal 365 will expand until the compression land 364 of the collet seal assembly 360 resides in a relaxed position between the sleeve 320 and the stop land 223 of the housing 200. Expansion of the collet seal 365 will allow the ball 500 to pass through the collet seal 365 and exit the fluid loss device 100. After the ball 500 exits the fluid loss device 100, the ball 500 will pass through the blank production tubing 33, the well screen 31, the seal 32, and the sump packer 21 into the sump 22.

The ball 500 can be forced clear of the collet seal 365 by applying pressure to the upper surface of the ball 500. Force applied to the ball 500, due to the pressure above the ball 500, is transmitted to the shear pins 370 by the collet seal assembly 360. When the force exerted on the ball 500 is great enough to sever the shear pins 370, the ball 500 and the collet seal assembly 360 will progress downward through the fluid loss device 100 until the compression land 364 of the collet seal assembly 360 clears the compression land 324 of the sleeve 320. Once the compression land 364 of the collet seal assembly 360 clears the compression land 324 of the sleeve 320, the collet seal 365 will expand until the compression land 364 of the collet seal assembly 360 resides in a relaxed position between the sleeve 320 and the stop land 223 of the housing 200. Expansion of the collet seal 365 will allow the ball 500 to pass through the collet seal 365 and exit the fluid loss device 100. After the ball 500 exits the fluid loss device 100, the ball 500 will pass through the blank production tubing 33, the well screen 31, the seal 32, and the sump packer 21 into the sump 22.

The ball 500 can be cleared from the collet seal 365 by applying chemicals to the ball 500 that erode the outer diameter 510 of the ball 500. In one embodiment, the ball 500 is formed of brass and acid is used to erode the ball 500. Once the outer diameter 510 of the ball 500 has eroded to a diameter smaller than the inner diameter 362 of the collet seal 365, the ball 500 will pass through the collet seal 365 and exit the fluid loss device 100. Once the ball 500 exits the fluid loss device 100, the ball 500 will pass through the blank production tubing 33, the well screen 31, the seal 32, and the sump packer 21 in to the sump 22. After the ball 500 has exited the fluid loss device 100, the collet seal assembly 360 can be placed in a relaxed position by mechanically applying a downward force to the collet seal assembly 360 until the shear pins 370 sever and the compression land 364 of the collet seal assembly 360 clears the compression land 324 of the sleeve 320. Once the compression land 364 of the collet seal assembly 360 clears the compression land 324 of the sleeve 320, the collet seal 365 will expand until the compression land 364 of the collet seal assembly 360 resides in a relaxed position between the sleeve 320 and the stop land 223 of the housing 200.

Figure 8:
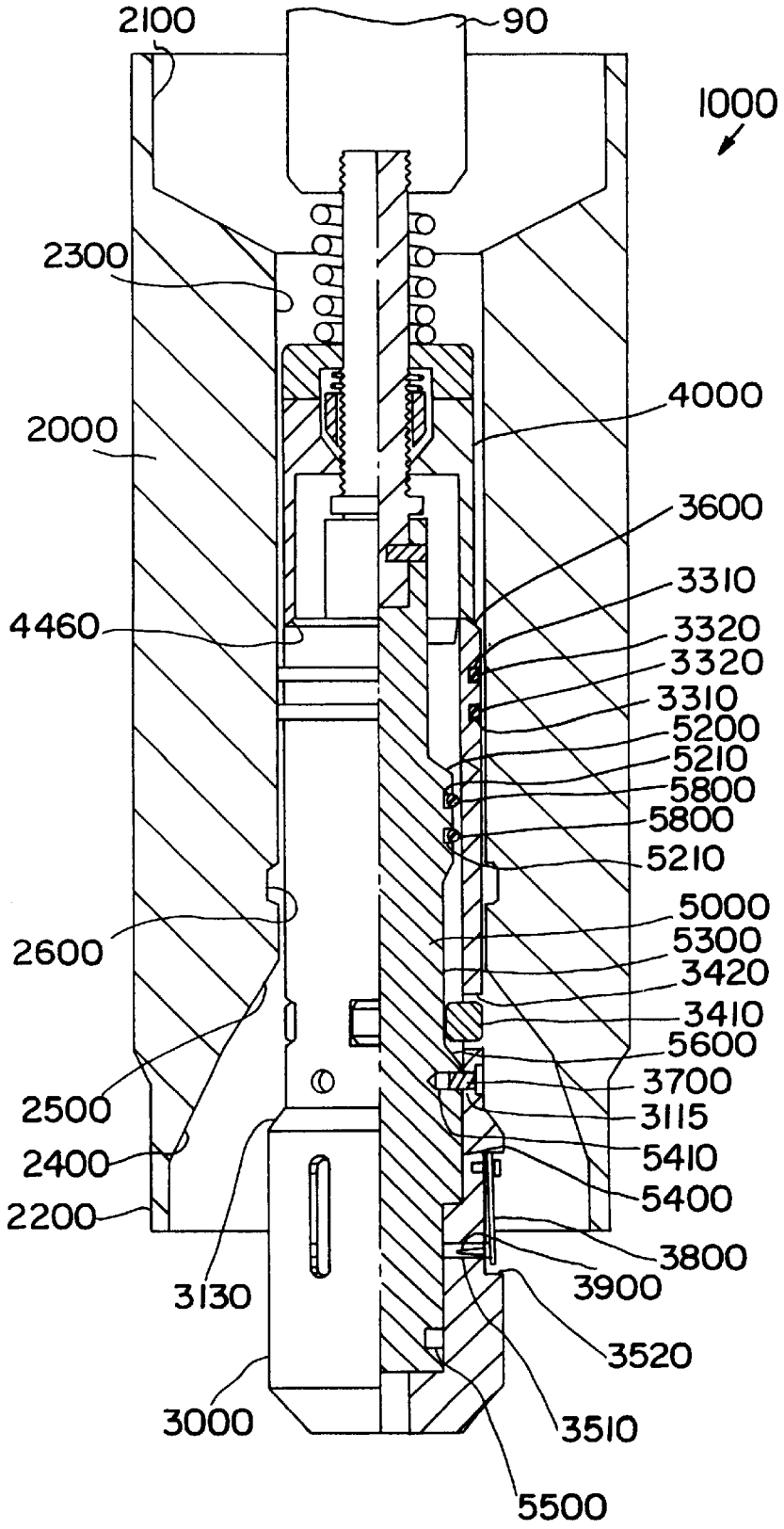
FIG. 8 is an enlarged fragmentary view in section and elevation of another embodiment of the fluid loss device in FIGS. 1 and 2.

Another embodiment of the fluid loss device 10 of FIGS. 1 and 2 is illustrated in FIG. 8 as the fluid loss device 1000. The fluid loss device 1000 generally comprises a housing 2000, a seal assembly 3000, a running tool assembly 4000, and a plug 5000. An upper portion of the housing 2000 has a threaded interface aperture 2100 that attaches to the upper packer 24 (shown in FIGS. 1 and 2), and a lower portion of the housing 2000 has a threaded interface nipple 2200 that attaches to the blank tubing 33 (shown in FIGS. 1 and 2). An inner diameter 2300 of the housing 2000 is connected to an expanded lower opening 2400 by a seal interface surface 2500. The housing 2000 also has stop dog recesses 2600 in the inner diameter 2300.

Figure 9:
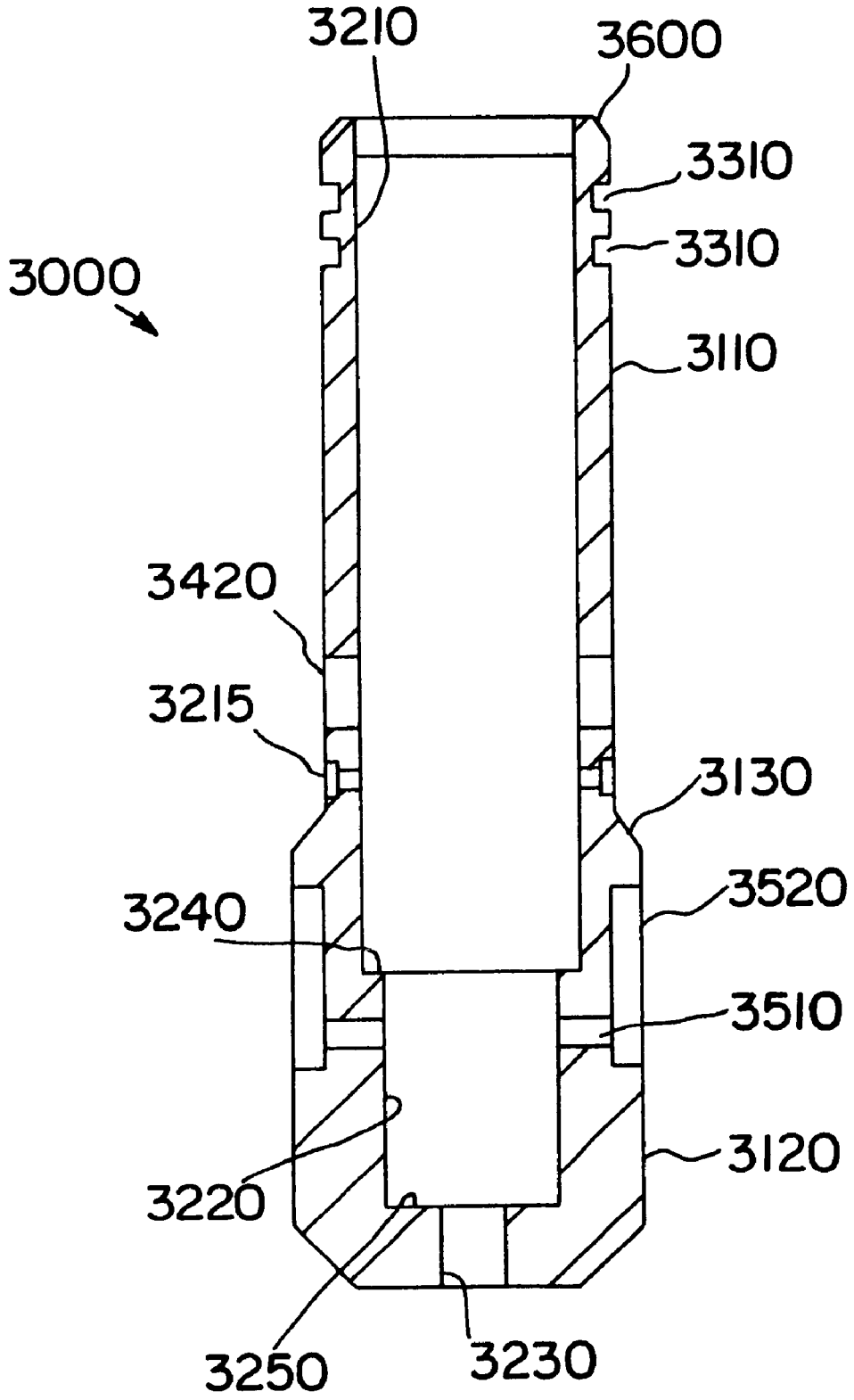
FIG. 9 is a sectional view of the seal assembly in FIG. 8.

In one embodiment, the seal assembly 3000, as shown in FIGS. 8 and 9, has an upper or first outer diameter 3110 and a lower or second outer diameter 3120. The first outer diameter 3110 of the seal assembly 3000 is smaller than the inner diameter 2300 of the housing 2000. The second outer diameter 3120 of the seal assembly 3000 is larger than the inner diameter 2300 of the housing 2000 but smaller than the expanded lower opening 2400 of the housing 2000. A stop land 3130 is created between the first outer diameter 3110 and the second outer diameter 3120 of the seal assembly 3000.

The seal assembly 3000 also has an upper or first inner diameter 3210, a middle or second inner diameter 3220, and a lower or third inner diameter 3230. The first inner diameter 3210 is larger than the second inner diameter 3220, thereby creating a first inner stop land 3240 between the two diameters. The second inner diameter 3220 is larger than the third inner diameter 3230, thereby creating a second inner stop land 3250. Seals 3320 reside within seal grooves 3310 in the first outer diameter 3110 of the seal assembly 3000. A running tool skirt interface edge 3600 is created on an upper portion of the seal assembly 3000 between the first inner diameter 3210 and the first outer diameter 3110. A plurality of stop dogs 3410 reside within stop dog apertures 3420 between the first inner diameter 3210 and the first outer diameter 3110 of the seal assembly 3000. Shear pin apertures 3510 extend between the second inner diameter 3220 and spring recesses 3520 in the second outer diameter 3120.

Figure 10:
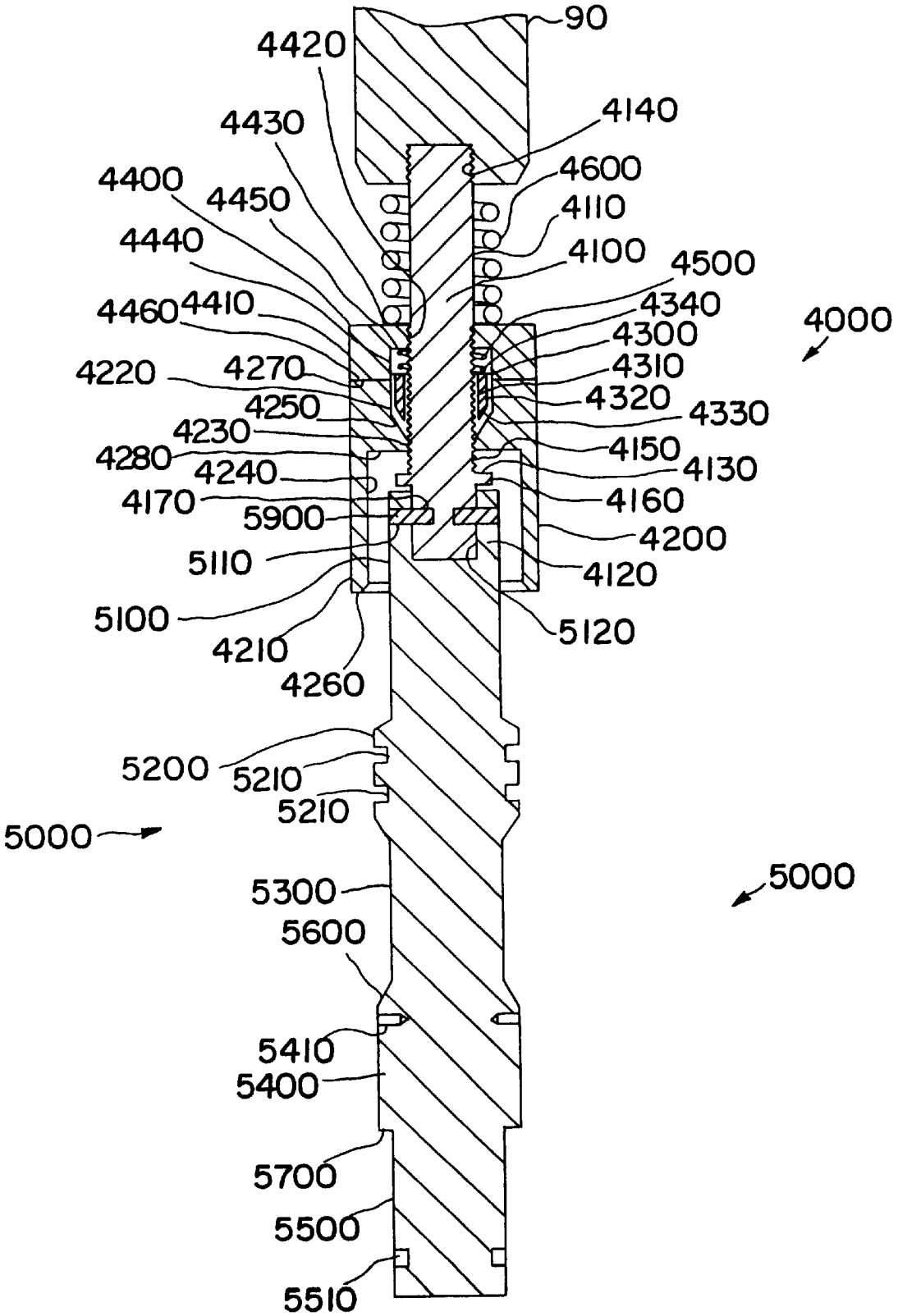
FIG. 10 is a sectional view of the wash pipe assembly, running tool assembly, and plug in FIG. 8.

The running tool assembly 4000, as shown in FIGS. 8 and 10, generally comprises a running tool mandrel 4100, a running tool skirt 4200, locking segments 4300, running tool skirt cap 4400, a locking segment spring 4500, and a running tool skirt spring 4600. The running tool mandrel 4100 has an upper or first outer diameter 4110 and a lower or second outer diameter 4120. A stop ring 4160 separates the first outer diameter 4110 from the second outer diameter 4120. The stop ring 4160 has an upper land or skirt stop land 4130. On an upper portion of the first outer diameter 4110 are running tool mandrel mounting threads 4140 for securing the running tool assembly 4000 to the wash pipe assembly 90. On a lower portion of the first outer diameter 4110, near the stop land 4130, are a plurality of annular grooves or serrations 4150.

The running tool skirt 4200 has an outer diameter 4210 that is smaller than the inner diameter 2300 of the housing 2000. In one embodiment, the outer diameter 4210 of the skirt 4200 is approximately the same diameter as the first outer diameter 3110 of the seal assembly 3000. The running tool skirt 4200 also has an upper or first inner diameter 4220, a middle or second inner diameter 4230, and a lower or third inner diameter 4240. The second inner diameter 4230 of the running tool skirt 4200 is larger than the first outer diameter 4110 of the running tool mandrel 4100 but smaller than the stop ring 4160. The first inner diameter 4220 of the skirt 4200 is greater than the second inner diameter 4230, and a segment wedging surface 4250 joins the first inner diameter 4220 to the second inner diameter 4230. The third inner diameter 4240 of the skirt 4200 is also greater than the second inner diameter 4230, thereby creating a mandrel stop land 4280 between the two diameters.

The first outer diameter 4110 of the running tool mandrel 4100 is positioned within the second inner diameter 4230 of the skirt 4200, with the mandrel stop land 4280 of the skirt 4200 nearest to the stop land 4130 of the running tool mandrel 4100. A seal assembly interface edge 4260 is created between the third inner diameter 4240 and the outer diameter 4210 of the skirt 4200. The seal assembly interface edge 4260 of the running tool skirt 4200 is adapted for engagement with the running tool skirt interface edge 3600 of the seal assembly 3000. A cap mounting surface 4270 is created between the first inner diameter 4220 and the outer diameter 4210 of the skirt 4200.

Each of the locking segments 4300 have an inner surface 4310 that approximates the first outer diameter 4110 of the running tool mandrel 4100, and are serrated with grooves for mating with the serrated surface 4150 of the first outer diameter 4110 on the running tool mandrel 4100. Each of the locking segments 4300 also have an outer surface 4320 that approximates a diameter smaller than the first inner diameter 4220 of the skirt 4200. On a lower portion of each of the locking segments 4300, between the inner surface 4310 and the outer surface 4320, is a skirt interface edge 4330. The locking segments 4300 are positioned with the inner surfaces 4310 adjacent to the first outer diameter 4110 of the running tool mandrel 4100, the outer surfaces 4320 adjacent to the first inner diameter 4220 of the skirt 4200, and the skirt interface edge 4330 adjacent to the segment wedging surface 4250 of the skirt 4200. In a preferred embodiment, the skirt interface edge 4330 of the segments 4300 and the segment wedging surface 4250 of the skirt 4200 are tapered surfaces that force the locking segments 4300 against the running tool mandrel 4100 as the skirt 4200 is forced upward along the running tool mandrel 4100. On an upper portion of each of the locking segments 4300, between the inner surface 4310 and the outer surface 4320, is a locking spring interface edge 4340.

The running tool skirt cap 4400 has an outer diameter 4410 that is preferably the same diameter as the outer diameter 4210 of the skirt 4200. An upper or first inner diameter 4420 of the cap 4400 is greater than the first outer diameter 4110 of the running tool mandrel 4100. A skirt spring interface edge 4430 is created between the first inner diameter 4420 and the outer diameter 4410 of the skirt cap 4400. A lower or second inner diameter 4440 in the cap 4400 is preferably approximately the same diameter as the first inner diameter 4220 in the skirt 4200. The second inner diameter 4440 of the cap 4400 is greater than the first inner diameter 4420, thereby creating a segment spring interface land 4450 in the cap 4400. A skirt interface edge 4460 is created in a lower portion of the cap 4400 between the second inner diameter 4440 and the outer diameter 4410.

The cap 4400 is positioned with the first outer diameter 4110 of the running tool mandrel 4100 extending through the first inner diameter 4420 of the cap 4400, and the skirt interface edge 4460 of the cap 4400 secured against the cap mounting surface 4270 of the skirt 4200. The locking segment spring 4500 is positioned around the first outer diameter 4110 of the running tool mandrel 4100 such that force is applied between the segment spring interface land 4450 of the cap 4400 and the spring interface edges 4340 of the locking segments 4300. The running tool skirt spring 4600 is positioned around the first outer diameter 4110 of the running tool mandrel 4100 such that force is exerted between the skirt spring interface edge 4430 of the skirt cap 4400 and the wash pipe assembly 90.

The inner mandrel or plug 5000, as shown in FIGS. 8 and 10, has a first outer diameter 5100, a second outer diameter 5200, a third outer diameter 5300, a fourth outer diameter 5400, and a fifth outer diameter 5500, progressing from an upper portion of the plug 5000 to a lower portion of the plug 5000, respectively. The first outer diameter 5100 of the plug 5000 is smaller than the third inner diameter 4240 of the running tool skirt 4200. The second outer diameter 5200 of the plug 5000 is smaller than the first inner diameter 3210 of the seal assembly 3000, and has seal recesses 5210 circumferentially around the plug body 5000 for seals 5800 see in FIG. 8. The fourth outer diameter 5400 of the plug 5000 is smaller than the first inner diameter 3210 of the seal assembly 3000. The third outer diameter 5300 of the plug 5000 is smaller than the fourth outer diameter 5400. A stop dog cam surface 5600 is created between the third diameter 5300 and the fourth diameter 5400. The fifth outer diameter 5500 of the plug 5000 is smaller than the second inner diameter 3220 of the seal assembly 3000. The fifth inner diameter 5500 of the plug 5000 is also smaller than the fourth inner diameter 5400, thereby creating a stop land 5700 between the two diameters for engagement with the first inner stop land 3240 of the seal assembly 3000. Shear pin recesses 5510 are also located in the fifth diameter of the plug 5000.

A mandrel mounting aperture 5120 is disposed within an upper portion of the plug 5000. The second diameter 4120 of the running tool mandrel 4100 is secured within the mandrel mounting aperture 5120 of the plug by shear pins 5900 engaging shear pin apertures 5110 in the plug 5000 and shear pin apertures 4170 in the running tool mandrel 4100. The second outer diameter 5200, the third outer diameter 5300, the fourth outer diameter 5400, and the fifth outer diameter 5500 of the plug 5000 are secured within the first inner diameter 3210 and the second inner diameter 3220 of the seal assembly 3000 by shear pins 3700 engaging shear pin apertures 5410 in the fourth diameter 5400 of the plug 5000 and shear pin apertures 3115 in the first inner diameter 3210 of the seal assembly 3000. Springs 3800 are secured within the spring pin recesses 3520 of the seal assembly 3000 and apply a force to shear pins 3900 residing in the shear pin apertures 3510, such that the shear pins 3900 are forced against the fifth inner diameter 5500 of the plug 5000.

Stop dogs 3410 reside within the stop dog apertures 3420 in the seal assembly 3000. The stop dog apertures 3420 are located such that the third outer diameter 5300 of the plug 5000 creates a stop dog release surface and the fourth outer diameter 5400 creates a stop dog lock surface. In this manner, movement of the plug 5000 relative to the seal assembly 3000 will cause the stop dogs 3410 to follow the stop dog cam surface 5600 to move between the stop dog release surface, or third outer diameter 5300, and the stop dog lock surface, or fourth outer diameter 5400. When the stop dogs 3410 rest against the stop dog release surface 5300, the stop dogs 3410 will reside within the stop dog apertures 3420 in the seal assembly 3000 and will not extend out from the first outer diameter 3110 of the plug 3000. When the stop dogs 3410 rest against the stop dog lock surface 5400, the stop dogs 3410 will extend outwardly from the plug 5000 such that the stop dogs 3410 will reside in both the stop dog apertures 3420 in the seal assembly 3000 and the stop dog recesses 2600 in the housing 2000.

Figure 11A:
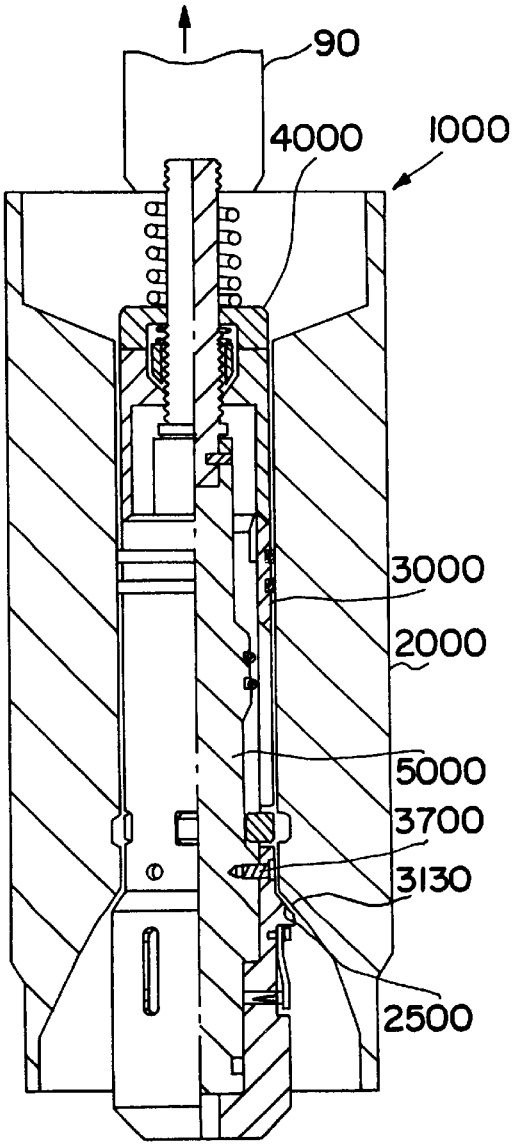
FIGS. 11A–11F are sectional views illustrating operation of the fluid loss device in FIGS. 8–10.

In one operation to activate the fluid loss device 1000, the wash pipe assembly 90 and the running tool 4000 are drawn upwardly through the fluid loss device 1000 until the stop land 3130 of the seal assembly 3000 engages the seal interface surface 2500 of the housing 2000, as shown in FIG. 11A. The wash pipe assembly 90 and running tool 4000 continue to be lifted upwardly through the fluid loss device 1000, shearing the shear pins 3700 that secure the seal assembly 3000 to the plug 5000.

Figure 11B:
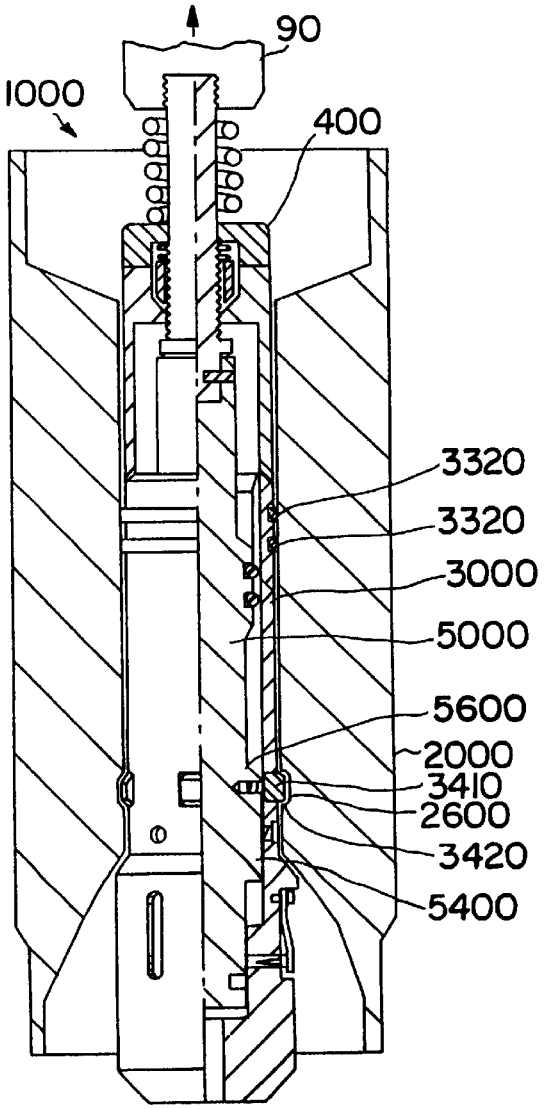

Continued upward movement of the wash pipe assembly 90 and the running tool 4000 will cause the stop dogs 3410 to progress along the stop dog cam surface 5600 until the stop dogs 3410 engage the stop dog locking surface or fourth outer diameter 5400 of the plug 5000, as shown in FIG. 11B, thereby kicking the stop dogs 3410 outwardly into the stop dog recesses 2600 in the housing 2000. In this manner, the seal assembly 3000 will be secured to the housing 2000 by the stop dogs 3410 located in the stop dog apertures 3420 of the seal assembly 3000 and the stop dog recesses 2600 in the housing 2000. The seals 3320 provide a seal between the seal assembly 3000 and the housing 2000. Continued upward movement of the wash pipe assembly 90 and the running tool 4000 will draw the plug 5000 upwardly through the seal assembly 3000.

Figure 11C:
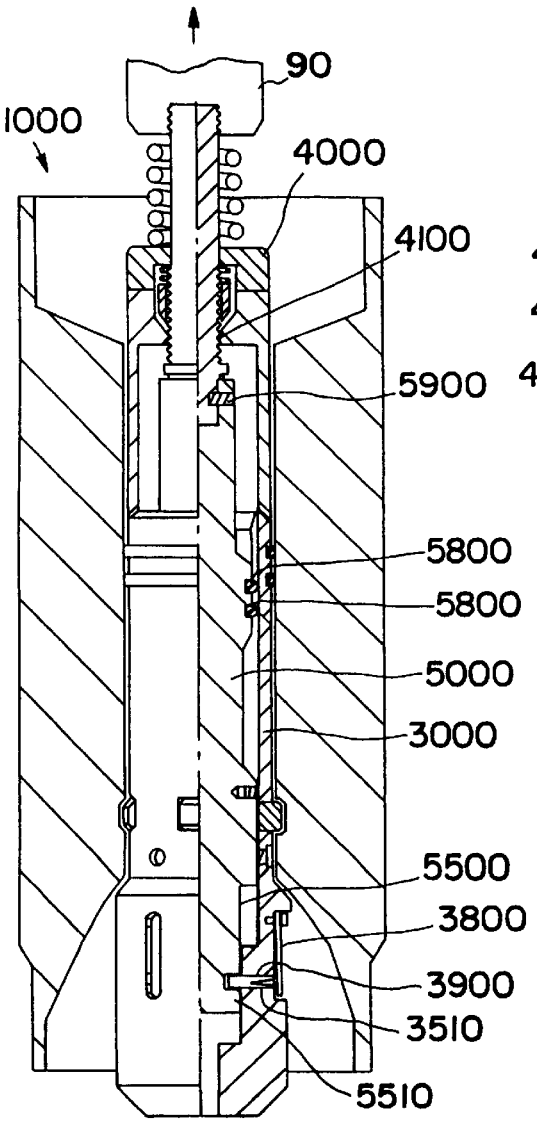

Once the shear pin recesses 5510 in the fifth outer diameter 5500 of the plug 5000 align with the shear pins 3900 residing in the shear pin apertures 3510 of the seal assembly 3000, the springs 3800 will force the shear pins 3900 into the shear pin recesses 5510, as shown in FIG. 11C, thereby securing the plug 5000 to the seal assembly 3000. The seals 5800 will seal between the plug 5000 and the seal assembly 3000. Continued upward movement of the wash pipe assembly 90 and the running tool 4000 through the fluid loss device 1000 will sever the shear pins 5900 securing the plug 5000 to the running tool mandrel 4100.

Figure 11D:
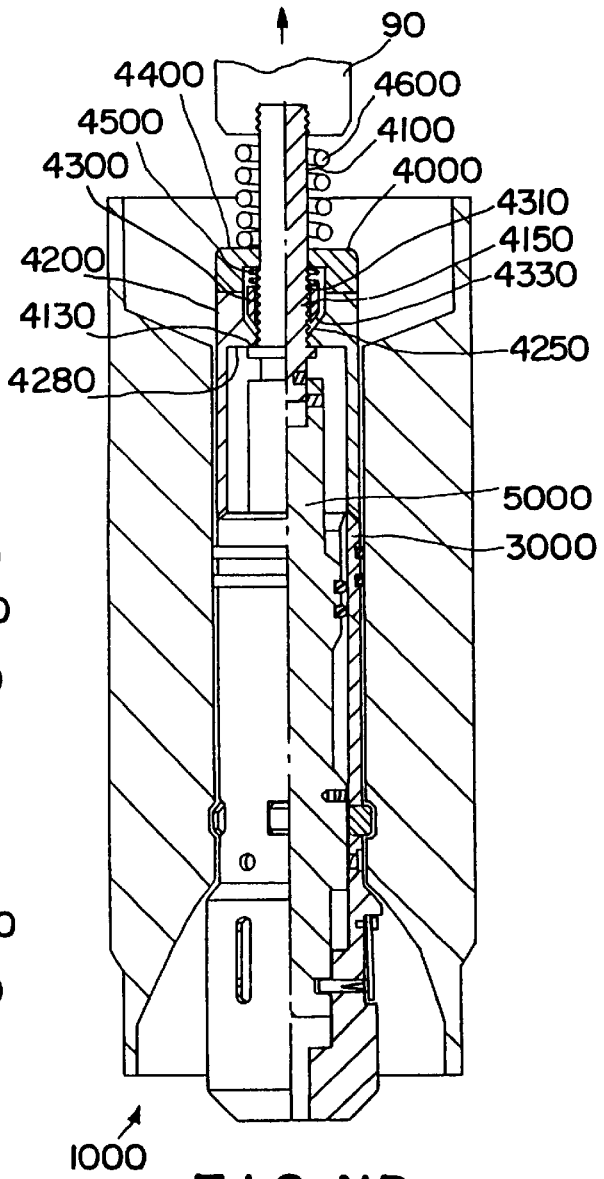

As the wash pipe assembly 90 and the running tool mandrel 4100 continue to move upward through the fluid loss device 1000, the running tool skirt spring 4600 will force the running tool skirt cap 4400 and the running tool skirt 4200 downwardly on the running tool mandril 4100 until the mandrel stop land 4280 of the running tool skirt 4200 engages the skirt stop land 4130 of the running tool mandrel 4100, as shown in FIG. 11D. In the position where the skirt stop land 4130 of the running tool mandrel 4100 engages the mandrel stop land 4280 of the running tool skirt 4200, the running tool mandrel 4100 is swallowed or protected by the running tool skirt 4200. In the swallowed or protected position, the skirt 4200 will engage the seal assembly 3000 upon any downward movement of the running tool 4000 before the running tool mandrel 4100 can engage the plug 5000.

The protected condition of the running tool 4000 is maintained by the locking segments 4300. The locking segment spring 4500 forces the locking segments 4300 downward until the skirt interface edge 4330 of the locking segments 4300 engages the segment wedging surface 4250 of the running tool skirt 4200. The angled surface of the segment wedging surface 4250 against the skirt interface edge 4330 of the locking segments 4300, forces the serrated inter surface 4310 of the locking segments 4300 against the serrated surface 4150 on the first outer diameter 4110 of the running tool mandrel 4100. Engagement by the locking segments 4300 with the serrated surface 4150 on the running tool mandrel 4100 and the segment wedging surface 4250 of the running tool skirt 4200, will lock the running tool skirt 4200 and running tool skirt cap 4400 in the swallowed or protected position over the running tool mandrel 4100. In the locked swallowed position, should the running tool 4000 progress downwardly, the running tool skirt 4200 will always engage the seal assembly 3000 before the running tool mandrel 4100 can engage the plug 5000. Thus, the locked swallowed position of the running tool 4000 will prevent disengagement of the fluid loss device 1000 which would be caused by dislodging the plug 5000 in the seal assembly 3000 should the running tool 4000 inadvertently move downwardly after the plug 5000 is secured within the seal assembly 3000.

Figure 11E:
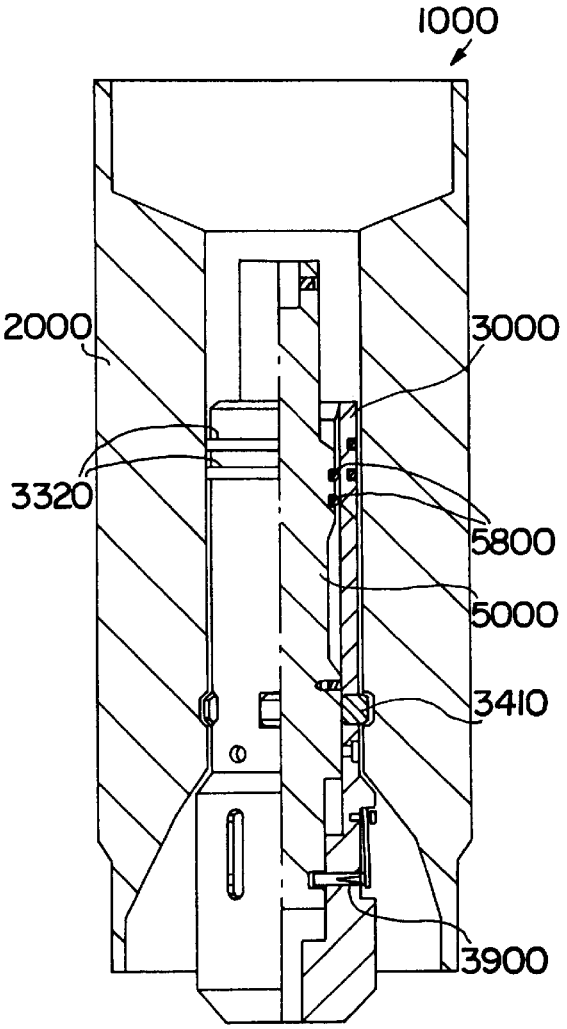

Once the running tool mandrel 4100 has separated from the plug 5000, the fluid loss device 1000 is in an activated condition and the wash pipe 90 and running tool 4000 can be removed, as shown in FIG. 11E. In the activated position, the seals 3320 provide a seal between the housing 2000 and the seal assembly 3000, and the seals 5800 provide a seal between the seal assembly 3000 and the plug 5000. Thus, in the activated position, the fluid loss device 1000 prohibits communication between above and below the fluid loss device 1000. The stop dogs 3410 and the shear pins 3900 inhibit movement of the plug 5000 and seal assembly 3000 in either an upward or downward direction. Thus, the fluid loss device 1000 device prohibits communication in either an upward or downward direction.

Figure 11F:
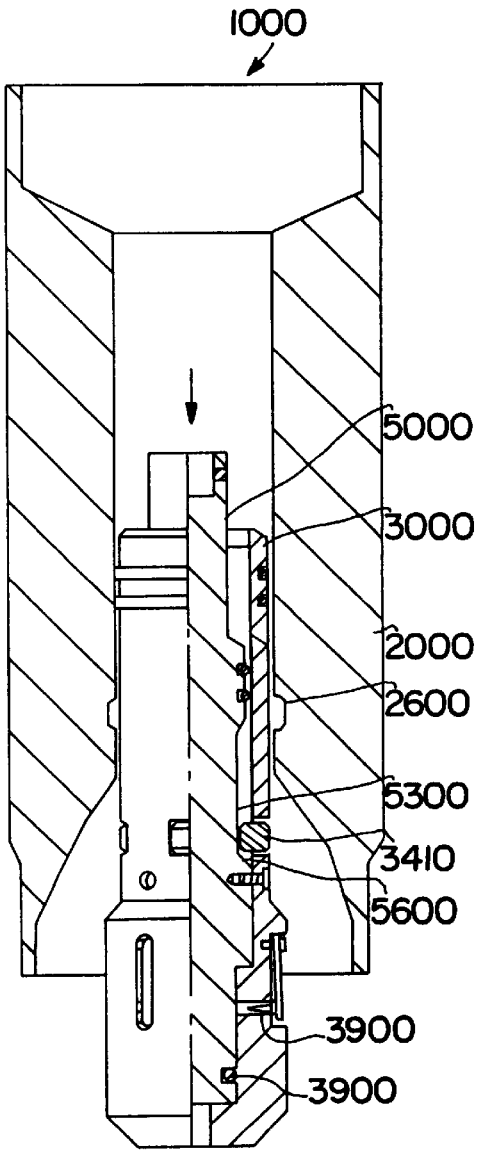

At some point after the running tool 4000 is separated from the plug 5000, it will be desired to deactivate or open the fluid loss device 1000 to once again allow flow through the fluid loss device 1000, as shown in FIG. 11F. To disengage the fluid loss device 1000, a mechanical or hydraulic force is applied to the upper end of the plug 5000, until the shear pins 3900 securing the plug 5000 to the seal assembly 3000 are severed. After the shear pins 3900 are severed, continued downward force on the plug 5000 will force the plug 5000 to move downwardly through the seal assembly 3000, until the stop dogs 3410 slide back into the seal assembly 3000 along the stop dog cam surface 5600 of the plug 5000 into engagement with the stop dog release surface or third outer diameter 5300 of the plug 5000. Once the stop dogs 3410 engage the third outer diameter 5300 of the plug 5000, the stop dogs 3410 have kicked inwardly and disengaged the stop dog recesses 2600 in the housing 2000. Once the stop dogs 3410 disengage the stop dog recesses 2600 of the housing 2000, the seal assembly 3000 and plug 5000 will exit the fluid loss device 1000 and pass through the blank production tubing 33, the well screen 31, the seal 32, and the sump packer 21 into the sump 22.

Use of the fluid loss device 100 or the fluid loss device 1000 as the fluid loss device 10 provides a device for isolating a zone 23 of a well bore 1 that can be re-opened at a later time. The plug and related components of the present invention fall to the sump area 22 and are widely accepted in the industry as items that can be left in a well bore 1. The large size of the plug and the seal assembly allow high flow rates into and out of the zone to be isolated before that zone is isolated.

Although a preferred embodiment of the apparatus and methods of the present invention has been illustrated in the accompanying Drawings and described in the foregoing Detailed Description, it will be understood that the invention is not limited to the embodiment disclosed, but is capable of numerous rearrangements, modifications and substitutions without departing from the spirit of the invention as set forth and defined by the following claims.

What is claimed is:

1. A fluid loss device comprising:

a housing having a longitudinal bore therethrough;

a seal assembly having a plug bore therethrough;

a running tool;

a plug detachably attached to the running tool;

a housing seal for sealing between the seal assembly and the longitudinal bore in the housing;

means for releasably securing the seal assembly within the longitudinal bore of the housing such that the housing seal provides a seal between the seal assembly and the longitudinal bore of the housing;

a plug seal for sealing engagement between the plug bore of the seal assembly and the plug; and means for releasably securing the plug within the plug bore of the seal assembly such that the plug seal provides a seal between the plug and the plug bore of the seal assembly:

wherein:

the plug has a shear pin recess in a shear pin surface; the seal assembly has a shear pin aperture;

the means for securing the plug includes a shear pin disposed within the shear pin aperture of the seal assembly and means for forcing the shear pin against the shear pin surface of the plug such that alignment of the shear pin recess in the plug with the shear pin forces the shear pin into engagement with the shear pin recess of the plug and the shear pin aperture of the seal assembly.

2. A fluid loss device comprising:

a housing having a longitudinal bore therethrough;

a seal assembly having a plug bore therethrough;

a running tool;

a plug detachably attached to the running tool;

a housing seal for sealing between the seal assembly and the longitudinal bore in the housing;

means for releasably securing the seal assembly within the longitudinal bore of the housing such that the housing seal provides a seal between the seal assembly and the longitudinal bore of the housing;

a plug seal for sealing engagement between the plug bore of the seal assembly and the plug; and means for releasably securing the plug within the plug bore of the seal assembly such that the plug seal provides a seal between the plug and the plug bore of the seal assembly;

wherein the running tool further comprises:

a running tool mandrel having a skirt stop land and means for detachably attaching the plug;

a running tool skirt having a mandrel stop land;

means for engaging the skirt stop land of the running tool mandrel with the mandrel stop land of the running tool skirt;

wherein the skirt stop land of the running tool mandrel and the mandrel stop land of the running tool skirt are positioned such that when the plug detaches from the running tool mandrel the skirt stop land of the running tool mandrel contacts the mandrel stop land of the running tool skirt and the running tool skirt inhibits the running tool mandrel from contacting the plug.

3. The device as set forth in claim 2, wherein the means for engaging the skirt stop land of the running tool mandrel with the mandrel stop land of the running tool skirt includes means for applying a force to the running tool such that the mandrel stop land of the running tool skirt is forced into engagement with the skirt stop land of the running tool mandrel when the plug detaches from the running tool mandrel.

4. The device as set forth in claim 2 wherein the running tool skirt has a first inner diameter and a wedging surface, wherein the running tool mandrel has a first mandrel diameter disposed within the first inner diameter of the running tool skirt, and wherein the means for engaging the skirt stop land of the running tool mandrel with the mandrel stop land of the running tool skirt includes a locking segment located in an annular space between the first diameter of the running tool mandrel and the first inner diameter of the running tool skirt, the locking segment having an outer segment surface adapted for being positioned adjacent to the first inner diameter of the running tool skirt, an inner segment surface adapted for being adjacent to the first mandrel diameter of the running tool mandrel, and a skirt wedging interface edge adapted for engagement with the segment wedging surface of the running tool skirt.

5. The device according to claim 4, further including means for applying a force to the locking segment toward the segment wedging surface of the running tool skirt.

6. The device according to claim 4 wherein the first mandrel diameter of the running tool mandrel has annular grooves disposed adjacent to the inner segment surface of the locking segments for engagement therewith.

7. The device according to claim 6 wherein the inner segment surface of the locking segments has grooves for engagement with the annular grooves on the first mandrel diameter of the running tool mandrel.

* * * * *